United States Patent [19]

Inagaki et al.

[11] Patent Number: 4,457,675

[45] Date of Patent: Jul. 3, 1984

[54] VOLUMETRIC FLUID COMPRESSOR DEVICE

[75] Inventors: Mitsukane Inagaki, Anjyo; Mitsuhiro Hattori, Kariya; Hiromitsu Ono, Kariya, all of Japan

[73] Assignee: Kabushiki Kaisha Toyoda Jidoshokki Seisakusho, Kariya, Japan

[21] Appl. No.: 385,981

[22] Filed: Jun. 7, 1982

[30] Foreign Application Priority Data

Jun. 12, 1981 [JP] Japan ..... 56-91310

[51] Int. Cl.[3] ..... F04C 18/02; F04C 15/04

[52] U.S. Cl. ..... 418/14; 418/55; 418/57

[58] Field of Search ..... 418/14, 55, 57, 182

[56] References Cited

U.S. PATENT DOCUMENTS 3,817,664 6/1974 Bennett et al. ..... 418/55

FOREIGN PATENT DOCUMENTS 37521 3/1980 Japan ..... 418/55

60684 5/1980 Japan ..... 418/55

*Primary Examiner*—John J. Vrablik

*Assistant Examiner*—Theodore Olds

*Attorney, Agent, or Firm*—Jordan and Hamburg

[57] ABSTRACT

The volumetric fluid compressor device or so-called scroll type compressor device comprises a rotary shaft mounted centrally at the front side of a housing and a movable scroll member having its scroll portion partially contacted with a scroll portion of a fixed scroll member. Sealed chambers or compression chambers delimited between the two scroll portions are contracted towards the center for compressing the refrigerant gas therein. A slider is mounted at the inner end of the rotary shaft for reciprocation radially thereof. An offset pin having an axis offset from the axis of the rotary shaft is fast with the slider and carries the movable scroll member. The slider is normally urged by a compression spring in a direction to reduce the amount of offset, that is, to reduce the radius of offset rotation of the offset pin, and may be urged by the pressure in the compression chamber in a direction to increase the radius of offset rotation of the offset pin against resiliency of the compression spring. With increase in the radius of offset rotation, the contact pressure between the movable and fixed scroll portions is increased with resulting increase of the force of sealing.

9 Claims, 9 Drawing Figures

VOLUMETRIC FLUID COMPRESSOR DEVICE

FIELD OF THE INVENTION

This invention relates to a volumetric fluid compressor device, so-called scroll type compressor, having a movable scroll member and a fixed scroll member. The movable scroll member has its scroll portion offset from and partially contacted with a scroll portion of the fixed scroll member so that sealed chambers are defined between the scroll portions. Said sealed chambers are contracted towards the center with rotation of the scroll portion of the movable scroll member about the axis of the rotary shaft, so that the refrigerant gas contained in the sealed chambers are contracted and discharged towards the rear from the central part of the fixed scroll member.

BACKGROUND OF THE INVENTION

In general, it is required of this type of the compressor to reduce the rising torque at startup, to prevent abnormal pressure increase encountered in compressing the liquid, and to improve the quality of sealing in the compression chambers. In order to meet these requirements, it has been proposed to have the scroll portion of the movable scroll member slightly spaced apart from the scroll portion of the fixed scroll member during standstill, and to increase the amount of offset or the radius of offset rotation of the movable scroll member at startup by resorting to the centrifugal force or the pressure prevailing in the compression chamber, for contacting the movable and fixed scroll portions with each other for improving the sealing of the sealed or compression chambers.

A practical example is shown in FIG. 7 wherein a cylindrical sleeve 31 is loosely fitted radially movably on an offset pin 11 secured to the inner end of a rotary shaft 7, and a flange member 32 secured to the movable scroll member is mounted on the sleeve 31 by way of a radial needle bearing 17. An annular space defined by the outer surface of the offset pin 11 and the inner surface of the cylindrical sleeve 31 is divided by a pair of sealing members 33 into a pair of semiarcuate gaps 105, 106. The pressure in the compression chamber is conducted into one gap 105 through a pressure conduction chamber 34 and an air bleed opening 35 of the offset pin 11 for displacing the sleeve 31 outwards or away from the rotary shaft 7 so as to increase the radius of offset rotation of the movable scroll member (See Japanese Provisional Patent Publication No. 37521/1980).

With such a device, the offset pin 11 and the sleeve 31 are held to each other by sealing members 33. It is now supposed that the offset pin 11 has been subjected to a transverse force as a result of rotation thereof. Then, with a high pressure acting in the gap 105 as shown in FIG. 8, the central axis $0_3$ of the sleeve 31 (movable scroll member) may be deviated from a straight line l connecting a central axis $0_1$ of the rotary shaft 7 and a central axis $0_2$ of the offset pin 11, resulting in difficulties involved in elevating the contact pressure between the scroll portions. If the gap 105 is enlarged for avoiding these difficulties, the axis $0_3$ may be deviated further away from the straight line l and the mating relation between the offset pin 11 and the sleeve 31 may be affected more markedly. Hence, the gap 105 may not be enlarged beyond a certain value.

A further device of the type in which the radius of offset rotation of the movable scroll member is changed is shown in FIG. 9, wherein a slider 37 is reciprocably fitted in a slider groove 36 of the rotary shaft 7 and a boss 38 of a movable scroll member is supported by the slider 37. The slider 37 is urged by a coil spring 39 in a direction to reduce the radius of offset rotation of the movable scroll member. Upon initiation of compression, the oil stored in the housing may be introduced into the slider groove 36 via offset opening 40 in the rotary shaft 7 and pressurized under the centrifugal force of the rotary shaft for shifting the slider 37 in a direction to increase the radius of offset rotation of the movable scroll member.

However, when the compressor shown in FIG. 9 is used for a vehicle air conditioner, for example, the oil pressure acting in the slider groove 36 via offset opening 40 may be changed severely with fluctuations in the number of revolutions per minute of the vehicle engine, thus affecting the sealing force and the performance of compression.

OBJECTS OF THE INVENTION

It is an object of the present invention to provide a volumetric fluid compressor device wherein the rising torque at startup may be reduced and the abnormally elevated pressure in the compression chamber encountered in compressing the liquid may be released.

It is a further object of the present invention to provide a volumetric fluid compressor wherein the sealing force acting between the fixed and movable scroll portions may be changed responsively to pressure fluctuations occurring in the compression chamber.

It is a further object of the present invention to provide a volumetric fluid compressor wherein small interstices between the scroll portions due to dimensional tolerance or wear may be readily compensated for improving the quality of sealing.

Other objects of the present invention will become more apparent from perusal of the following description of the preferred embodiment and the appended claims. Many advantages not alluded to in the specification will readily occur to those skilled in the art upon execution of the invention.

DETAILED DESCRIPTION OF THE PREFERRED EMBODIMENT

Figure 1:
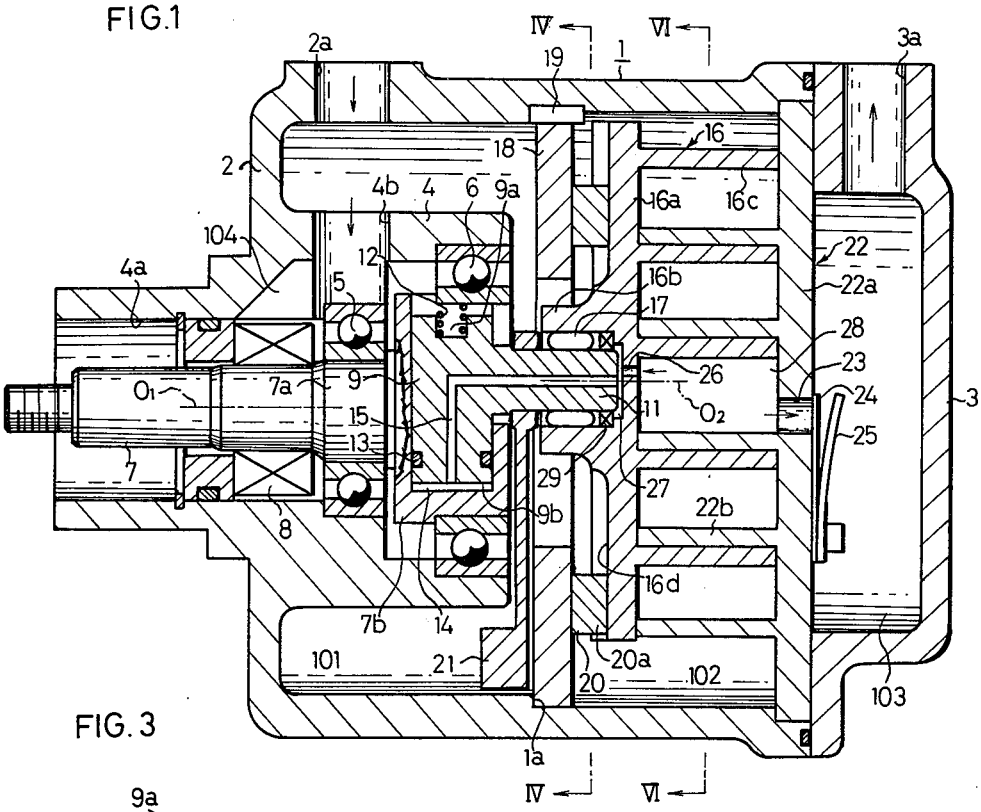
FIG. 1 is a central longitudinal sectional view of the volumetric fluid compressor embodying the present invention.

Referring to FIGS. 1 to 6 for illustrating a preferred embodiment of the present invention, a central housing 1 has a front surface (the left-hand end surface in FIG. 1) integrally formed with a front housing 2 and a rear surface secured to a rear housing 3 by fastening bolts, not shown.

The front housing 2 is formed integrally with a cylindrical boss 4 having a bore 4a in which radial ball bearings 5, 6 of different diameters are disposed for mounting a small diameter portion 7a and a large diameter portion 7b of a rotary shaft 7. A shaft sealing mechanism 8 is mounted in a sealing chamber 104 between the rotary shaft 7 and the boss 4, and an inlet port 4b for refrigerant gas is bored in the upper part of the boss 4 in communication with the upper zone of the sealing chamber 104.

Figure 3:
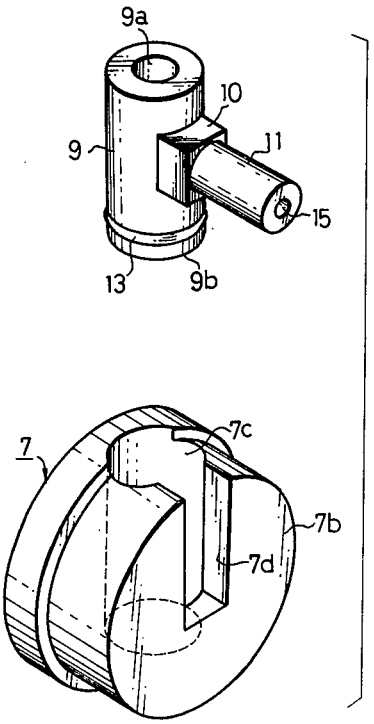
FIG. 3 is an exploded perspective view showing the slider mounted to the large diameter inner end of the rotary shaft.
Figure 2:
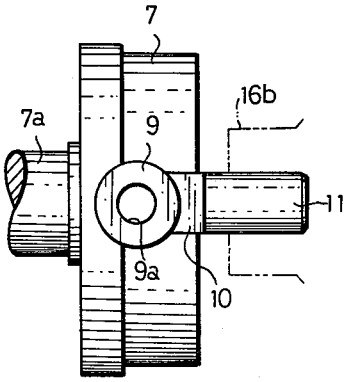
FIG. 2 is a plan view showing the slider mounted to the large diameter inner end of the rotary shaft.

As shown in FIG. 3, the large diameter portion 7b of the rotary shaft 7 is formed with a radially extending slider groove 7c in the form of a bottomed cylinder and with a guide groove 7d opening or exposing said slider groove 7c to the end face of the large diameter portion 7b over a certain radial depth. In the slider groove 7c and the guide groove 7d, a cylindrical slider 9 and an integral projection 10 thereof are respectively inserted for reciprocation radially of the rotary shaft 7. An offset pin 11 is integrally mounted to the rear surface of the projection 10.

A compression coil spring 12 is mounted between a circular recess 9a in the peripheral surface of the slider 9 and the inner race of the radial ball bearing 6. The spring 12 acts for biasing said slider 9 in a direction to reduce the amount of offset between an axis $0_1$ of the rotary shaft 7 and an axis $0_2$ of the offset pin 11. An O-ring 13 is fitted in an annular groove formed in the periphery of the slider 9 towards its inner end face 9b. A pressure chamber 14 sealed hermetically is defined between the bottom of the slider groove 7c and the inner end face 9b of the slider 9. A pressure duct 15 is bored through the slider 9 and the offset pin 11 for opening or exposing said pressure chamber 14 to the end face of the offset pin 11. When an elevated pressure acts in the chamber 14 through the pressure duct 15, the slider 9 is shifted against the force of spring 12 in a direction to increase the amount of offset, that is, the radius of offset rotation, of the offset pin 11.

Figure 6:
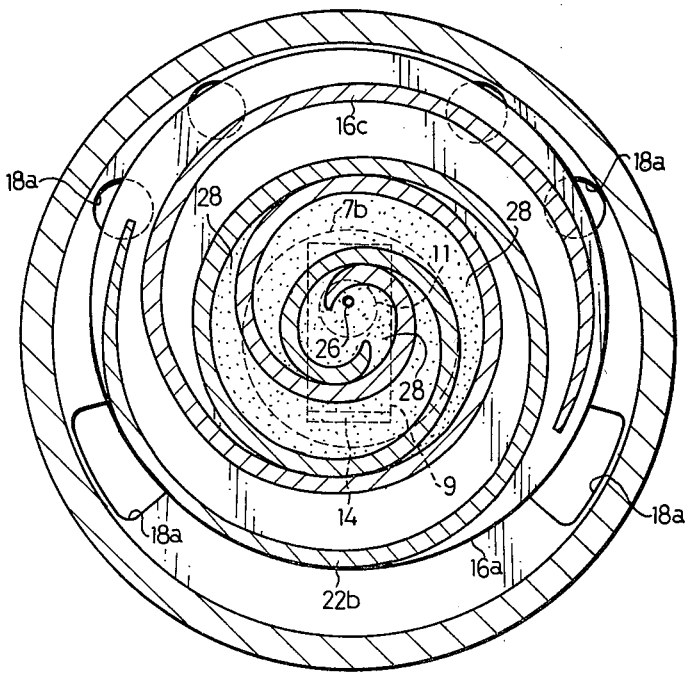
FIG. 6 is a sectional view taken along line VI—VI of FIG. 1.
Figure 7:
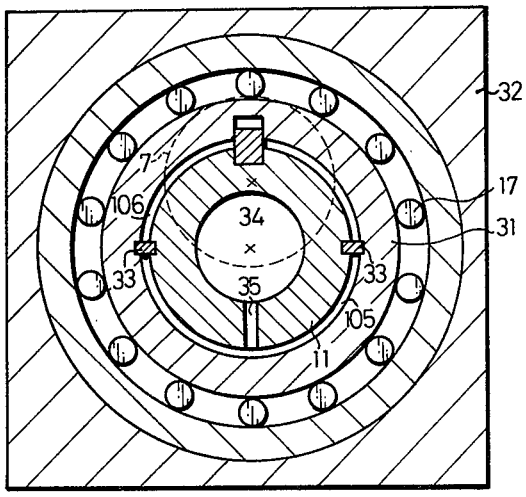
FIG. 7 PRIOR ART
FIGS. 7 and 8 are diagrammatic sectional views showing a conventional volumetric fluid compressor.
Figure 8:
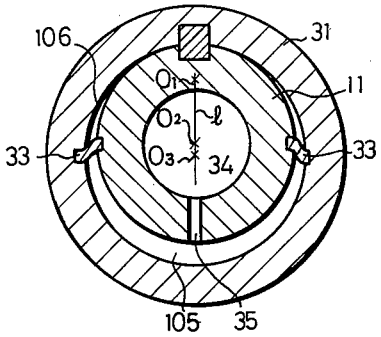
FIG. 8 PRIOR ART
Figure 9:
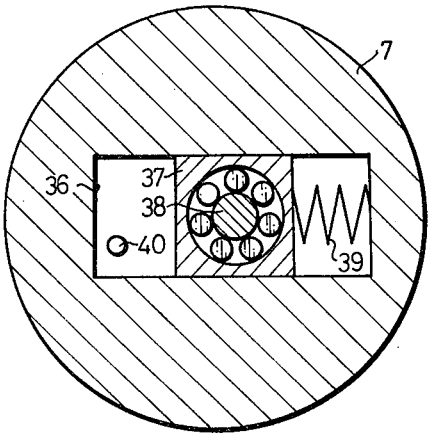
FIG. 9 PRIOR ART
FIG. 9 is a diagrammatic sectional view showing another conventional volumetric fluid compressor.

A movable scroll member 16 has a circular plate portion 16a and a central boss portion 16b formed integrally with the forward surface of the plate portion 16a, and is mounted for rotation on the offset pin 11 at the boss portion 16b thereof by way of a radial needle bearing 17. The movable scroll member 16 has a scroll portion 16c integrally formed on its rear surface as shown in FIG. 6.

The inner periphery of the central housing 1 has an annular step 1a to which a stationary ring 18 adapted to prevent the rotation of the movable scroll member 16 about its own axis is keyed at 19. The stationary ring 18 devides the inside of the housing 1 into two chambers, that is, a forward suction chamber 101 directing to the boss 4 and a rear working chamber 102 directing to the movable scroll member 16. A refrigerant gas is introduced into the suction chamber 101 from an outside circuit by way of suction port 2a in the upper periphery of the front housing 2. As shown in FIG. 6, the stationary ring 18 has six peripheral suction openings 18a for introducing the refrigerant gas from the suction chamber 101 into the working chamber 102.

Figure 4:
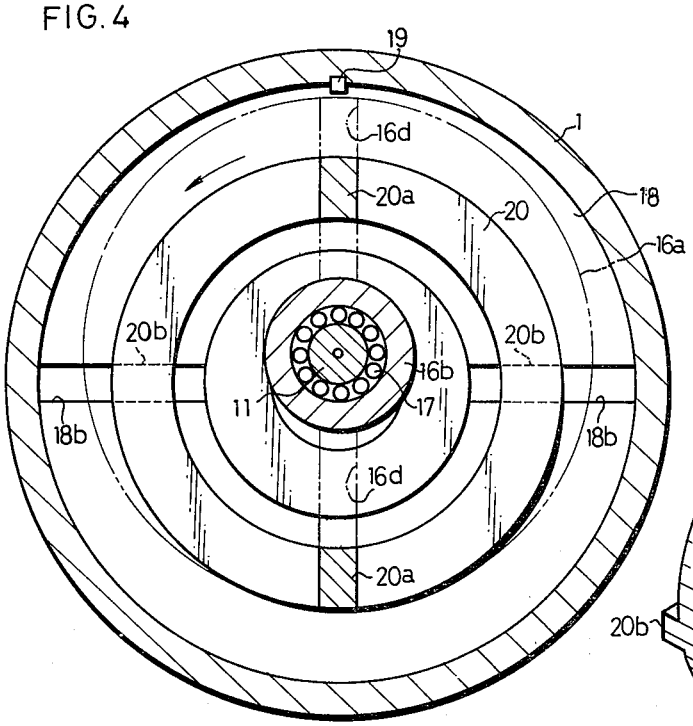
FIG. 4 is a sectional view taken along line IV—IV of FIG. 1.
Figure 5:
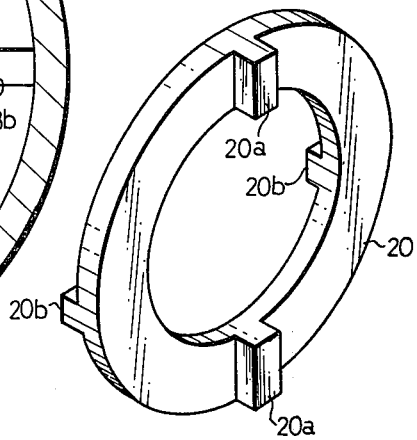
FIG. 5 is an enlarged perspective view showing a rotation lock ring.

As shown in FIGS. 1 and 4, the forward surface of the plate portion 16a of the movable scroll member 16 has a pair of guide grooves 16d extending vertically through the center of the plate portion. Also, as shown in FIG. 4, the rear surface of the fixed ring 18 has a pair of guide grooves 18b extending transversely through the center of the fixed ring. As shown in FIG. 5, a rotation inhibit ring member 20 has two upper and lower integral projections 20a on its rear surface for vertically movably engaging with the guide grooves 16d on the plate portion 16. The ring member 20 also has two transversely extending integral projections 20b on its forward surface for transversely slidably engaging with the guide grooves 18b on the fixed ring 18.

Thus, when the offset pin 11 is turned counterclockwise in FIG. 4 with rotation of the rotary shaft 7, delineating a circular path, the ring member 20 is displaced linearly towards left in FIG. 4, with the two projections 20b sliding along guide grooves 18b of the fixed ring 18. Thus the plate portion 16 is also moved towards left in FIG. 4, with the guide grooves 16d remaining in the vertical position, and may thus be locked against rotation about its own axis.

A balance weight 21 is secured to the offset pin 11 to permit smooth rotation of the movable scroll member 16 about axis $0_1$.

A circular plate member 22a of a fixed scroll member 22 is clampedly secured at the peripheral zone thereof between the central housing 1 and the end surface of the rear housing 3. The forward surface of the plate portion 22a is formed integrally with a scroll portion 22b, as shown in FIG. 6, so as to be contacted locally at two or more points with the scroll portion 16c of the movable scroll member 16. The plate portion 22a has a central discharge opening 23 for discharging the compressed refrigerant gas into a discharge chamber 103 defined between the rear housing 3 and the plate 22a. The rear housing 3 has an upper discharge port 3a for discharging the compressed refrigerant gas from the discharge chamber 103 into an outside circuit. The plate portion 22a has a discharge valve 24 and a retainer 25 in register with the discharge opening 23.

A pressure port 26 is formed through substantially the center of the plate portion 16a of the movable scroll member 16. This port 26 provides communication between a small chamber 27 defined by the end face of the offset pin 11 and the plate portion 16a and the innermost or central one of a plurality of compression chambers 28 indicated by numerous dots in FIG. 6 and defined by a plurality of contact points of the scroll portions 16c, 22b. The small chamber 27 is sealed by a sealing element 29 interposed between the offset pin 11 and the inner periphery of the boss portion 16b.

The compressor device operates as follows.

During standstill of the compressor, the pressure chamber 14 is maintained at a reduced pressure, and the slider 9 is biased by the compression spring 12 in the direction to reduce the amount of offset of the offset pin 11. With the scroll portion 16c of the movable scroll member just clear of the scroll portion 22b of the fixed scroll member 22, the compression chambers 28 are not sealed off.

During rotation of the rotary shaft 7, the movable scroll member 16 is brought into an offset rotation by the offset pin 11. The slider 9 is subjected to a centrifugal force and tends to be floated radially to overcome the force of the spring 12 to increase the radius of the offset rotation of the movable scroll member 16. The contact points between the scroll portions 16c, 22b may now be sealed more and more strongly resulting in a gradual increase of the pressure prevailing in the compression chambers 28. The pressure in the innermost or central compression chamber 28 then acts in the small chamber 27 through the pressure port 26 in the plate portion 16*a* of the movable scroll member 16 and thence in the pressure chamber 14 through pressure duct 15 in the offset pin 11 and the slider 9. Thus the slider 9 tends further to be floated radially to increase the radius of offset rotation of the movable scroll member 16. Thus the movable scroll portion 16*c* is pressed more strongly on the fixed helical portion 22*b*, resulting in stable sealing of the respective compression chambers 28 and smooth compressive operation.

During compressive operation, when the pressure in the compression chambers 28 is changed with changes in the RPM of the rotary shaft, the pressure in the chamber 14 is changed correspondingly and thus the contact pressure between the scroll portions 16*c*, 22*b* is also changed for maintaining the sealing force suited to the prevailing discharge pressure.

In case of liquid compression, above all, the pressure in the inside space of the compression chambers 28 tends to be raised abnormally. However, since the pressure port 26 and the pressure duct 15 are of a certain length and of a reduced diameter, pressure rise in the pressure chamber 14 is slightly delayed by the throttling action relative to that in the compression chamber 28. Thus the sealing force between the scroll portions 16*c* and 22*b* caused by the pressure in the chamber 14 is overcome by the force acting to release such sealing force under the elevated pressure in the compression chambers 28 so that the pressure in the chamber 28 may be prevented from reaching an abnormal value.

The stroke of the slider 9 in the preceding embodiment may preferably be 2 mm or thereabout. If any foreign matter less than such size be nipped between the movable and fixed scroll members 16*c*, 22*b*, such nipping may be tolerated or accommodated by the slider stroke and thus the scroll members 16, 22 and the parts associated therewith may not be damaged.

It is evident that the present invention may be embodied in broadly different modes within the spirit and scope thereof and hence the present invention is not to be limited to any specific embodiments except as defined in the appended claims.

What is claimed is:

1. In a volumetric fluid compressor comprising a housing, a rotary shaft rotationally mounted on the housing and having an inner end inside the housing, a groove portion provided at the inner end of the rotary shaft and extending in the diametral direction of the shafft, a slider radially slidably situated in the groove portion and having an offset pin extending parallel to the rotary shaft, a resilient member to urge the slider toward the center of the shaft, a movable scroll member rotationally connected to the offset pin and non-rotationally situated relative to the housing, and a fixed scroll member attached to the housing and being sealingly engaged relative to the movable scroll member, the improvement comprising bearing means situated around the inner end of the rotary shaft for rotationally supporting the inner end of the shaft relative to the housing, a pressure chamber provided at the innermost end of the groove portion and defined by the slider, said resilient member beng situated between the bearing means and the slider to urge the slider inwardly, and pressure conduction means provided in the movable scroll member and the slider for introducing the pressurized fluid into the pressure chamber to urge the slider outwardly against the resilient member by the pressurized fluid introduced thereinto so that the offset condition of the movable scroll member is controlled by the operation efficiency of the compressor.

2. A volumetric fluid compressor according to claim 1, in which said rotary shaft includes a cylindrical shaft portion at the inner end thereof longer than the other portion, and said groove portion includes a slider groove situated at the cylindrical shaft portion and extending in the diametral direction thereof, and a guide groove situated at the axial end of the cylindrical shaft portion parallel to and communicating with a part of the slider groove.

3. A volumetric fluid compressor according to claim 2, in which said slider is slidably situated in said slider groove and said offset pin is located in the guide groove so that when the rotary shaft is rotated, the movable scroll member is moved by means of the slider.

4. A volumetric fluid compressor according to claim 3, in which said slider groove is cylindrical and the slider is columnar.

5. A volumetric fluid compressor according to claim 2, in which said housing includes a boss, said bearing means being situated inside said boss to thereby support the inner end of the rotary shaft thereat.

6. A volumetric fluid compressor according to claim 2, in which said pressure conduction means situated in the movable scroll member and the slider is a pressure port and a pressure duct, pressurized fluid being gradually transmitted to the pressure chamber through said pressure port and pressure duct.

7. A volumetric fluid compressor comprising, a housing, a rotary shaft having an outer end outside the housing and an inner end inside the housing, bearing means situated at least around the inner end of the rotary shaft for rotationally supporting the rotary shaft relative to the housing, a groove portion provided in the inner end of the rotary shaft and extending in the diametral direction thereof, said groove portion having a pressure chamber at the innermost end thereof, a slider slidably situated in said groove portion of the rotary shaft, said slider having an offset pin extending away from the inner end of the rotary shaft and parallel to the rotary shaft and a pressure duct extending from the offset pin to the innermost end thereof to apply pressure to the pressure chamber of the groove, a resilient member disposed between the bearing means and the slider to urge the slider toward the center of the shaft, a movable scroll member rotationally connected to the offset pin and non-rotationally but slidably situated relative to the housing, said movable scroll member having a pressure port therein to allow the pressurized fluid to pass to the pressure chamber through the pressure duct of the slider, and a fixed scroll member connected to the housing, said fixed scroll member being sealingly engaged relative to the movable scroll member so that when the movable scroll member is actuated, fluid is gradually compressed, whereby the pressurized fluid is supplied to the pressure chamber in the groove to regulate the position of the slider to thereby effect a seal between the fixed scroll member and the movable scroll member.

8. A volumetric fluid compressor according to claim 7, in which said inner end of the rotary shaft is cylindrical and larger than the outer end thereof, and the groove portion includes a slider groove extending in the diametral direction of the rotary shaft, and a guide groove situated at the axial end of the rotary shaft parallel to and communicating with a part of the slider groove.

9. A volumetric fluid compressor according to claim 8, in which said slider is slidably situated in said slider groove and said offset pin is located in the guide groove, so that when the rotary shaft is rotated, the movable scroll member is thereby moved by the slider.

* * * * *